US007901173B2

(12) United States Patent
Spilker

(10) Patent No.: US 7,901,173 B2
(45) Date of Patent: Mar. 8, 2011

(54) POLE-POSITIONING DEVICE AND METHODS

(75) Inventor: Mark Spilker, Danville, CA (US)

(73) Assignee: Solar Foundation Solutions, Inc., San Jose, CA (US)

( * ) Notice: Subject to any disclaimer, the term of this patent is extended or adjusted under 35 U.S.C. 154(b) by 277 days.

(21) Appl. No.: 12/150,037

(22) Filed: Apr. 24, 2008

(65) Prior Publication Data

US 2008/0267739 A1 Oct. 30, 2008

Related U.S. Application Data

(60) Provisional application No. 60/926,154, filed on Apr. 24, 2007.

(51) Int. Cl.
*A01G 23/02* (2006.01)

(52) U.S. Cl. ..... 414/23; 414/911

(58) Field of Classification Search ..... 173/188–195, 173/37, 42, 44; 212/236; 414/23–24, 442, 414/555, 620, 631, 634, 680, 781, 783; 52/115–117, 52/120, 143; 901/22–23
See application file for complete search history.

(56) References Cited

U.S. PATENT DOCUMENTS 1,247,634 A * 11/1917 Budgeon et al. ..... 173/190
3,352,369 A 11/1967 Bodine, Jr.
3,507,338 A 4/1970 McWaters et al.
3,528,563 A * 9/1970 Valory et al. ..... 414/23
3,605,912 A 9/1971 Fisher
3,700,047 A 10/1972 Gartner
3,703,934 A 11/1972 Cartner
3,768,779 A 10/1973 Garretson
3,783,953 A 1/1974 Kopaska
4,364,540 A * 12/1982 Montabert ..... 248/654
4,656,743 A * 4/1987 Thiemann et al. ..... 33/1 H
5,002,437 A 3/1991 Giroux
5,028,180 A * 7/1991 Sheldon et al. ..... 409/201
5,029,651 A 7/1991 Ubbink
5,383,524 A * 1/1995 Rinnemaa ..... 173/1
5,580,480 A 12/1996 Chatelain
5,772,362 A 6/1998 Sims
6,315,059 B1 11/2001 Geldean
6,684,580 B1 2/2004 Hull
6,709,215 B1 3/2004 Sorensen
7,004,262 B1 2/2006 Viochoskie et al.

* cited by examiner

*Primary Examiner* — Gregory W Adams

(74) *Attorney, Agent, or Firm* — Adams Law Office; Sharon Adams

(57) ABSTRACT

Methods and devices for positioning a group, array, series or arrangement of plumb poles in a specific relationship relative to each other, whereby a first pole is inserted in a horizontal clamshell attached to a moveable platform, retained and raised to a vertical position and plumbed. The moveable platform is positioned over the pole insertion location and the pole is released. The process is repeated at as many holes as needed. Other embodiments are used to set the poles at specific heights, or angles.

17 Claims, 7 Drawing Sheets

POLE-POSITIONING DEVICE AND METHODS

CROSS-REFERENCE TO RELATED APPLICATION

This application claims priority to U.S. Provisional Patent Application 60/926,154, filed Apr. 24, 2007. Said provisional application is herein incorporated by reference in its entirety.

FIELD OF THE INVENTION

The present invention pertains generally to devices and methods for placing poles, shafts, I-beams, rods or other long objects in a specific location relative to each other, while at the same time ensuring that each long object is plumb, or is at a specific angle other than plumb.

DESCRIPTION OF THE RELATED ART

There are many situations where it is desirable or necessary to have a series of poles in a specific arrangement. For example, solar panels for large, commercial applications are generally supported by an array of poles. These poles must be exactly placed and plumb to allow a series of solar panels to move as the sun moves. Other examples include fence posts and light poles, which must be straight and placed at a specific distance. In other situations, poles must be placed in a specific array and at a specific angle.

BRIEF SUMMARY OF THE INVENTION

As used in this application, the word "pole" includes and is defined as any long, relatively straight object including but not limited to poles, fence posts, I-beams, rods, shafts or any other long and relatively straight object. The word "pole" shall include all of these meanings, and will be used for the sake of brevity.

The pole-positioning device is moveable, it may be transported, or it may have wheels and be self-powered to move across the ground to properly position a pole. The pole-positioning device contains a clamshell that holds a pole to be positioned and inserted in the ground. The clamshell moves between a vertical and horizontal orientation through a hinge that connects the bottom end of the clamshell to the bottom end of the clamshell support. When in the horizontal position, the clamshell is opened and a pole is loaded into the clamshell. The clamshell is closed and a compression device is tightened against the pole. The compression device exerts enough pressure to retain the pole inside the clamshell when vertical. The clamshell and pole are raised to a vertical position, and the clamshell is locked into place by locking mechanism on clamshell support. The locking mechanism may be any means known in the art to retain and release heavy objects.

The compression device is slightly released to allow the pole to lower, through gravity, until it is just above the ground. In one embodiment, the pole is then plumbed by using actuators to adjust the clamshell until a level or series of levels shows that the clamshell is directly vertical. In another embodiment, the pole may be adjusted, using the actuators, to a specific angle.

The moveable platform and associated clamshell are adjusted so that the pole is positioned directly over the desired spot for pole insertion. The moveable platform is adjusted though actuators that connect the moveable platform to a support platform system.

The compression device is fully released, and the pole drops. The pole retains its vertical, or angled, orientation while dropping through the clamshell. In one embodiment, the pole drops into wet concrete. In one embodiment, the pole is connected with a vibrator, and the vibrator is turned on causing the pole to sink further into the wet concrete. Once the pole reaches the desired depth, the vibrator is turned off, and the device is moved away from the pole. The pole-positioning device is moved to the next location where a pole will be placed, and the process is repeated.

Other embodiments of the invention include the ability to position and insert objects with a non-circular cross-section, such as I-beams. Still other embodiments include methods and devices for ensuring that each pole is at a specific height.

DETAILED DESCRIPTION OF THE INVENTION

Figure 1A:
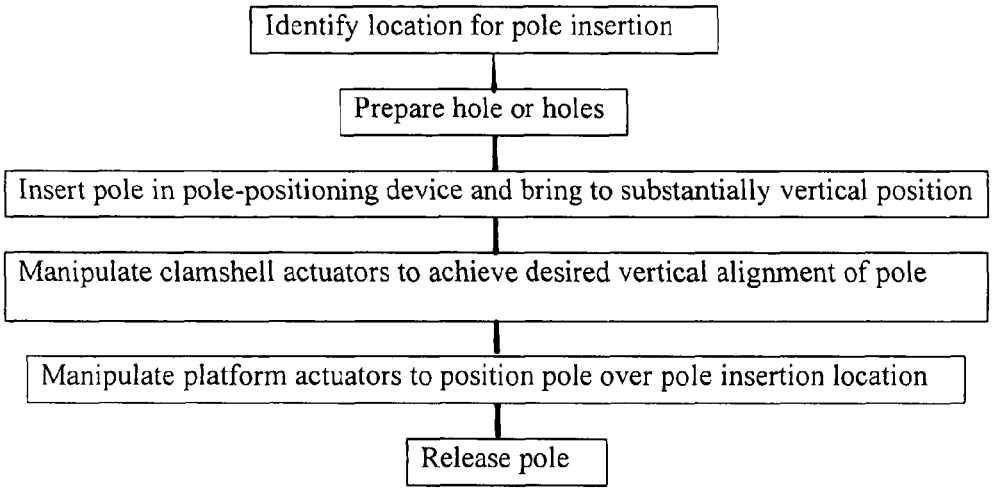
FIG. 1 shows methods of plumbing and positioning poles.
Figure 1B:
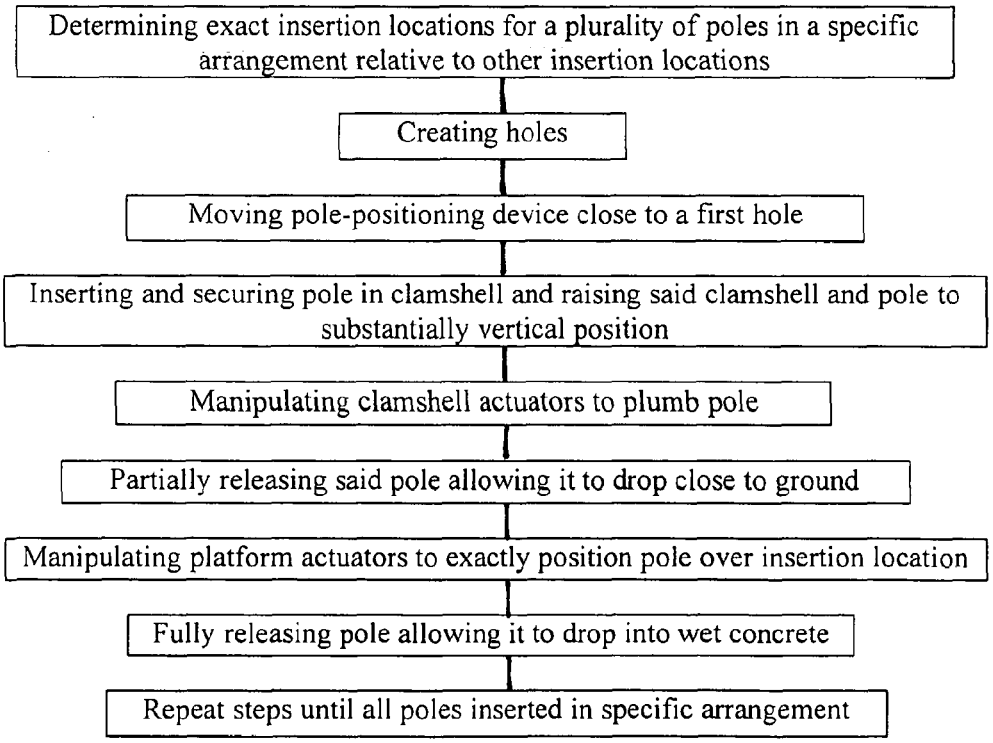

The device is used to position and insert a series, array, arrangement, or group of poles in a specific relationship to each other. In most cases the pole is inserted at a true vertical, or plumb, angle. The first step is to determine or locate the insertion location for each pole relative to other insertion locations. There are many different ways this can be accomplished, and the method chosen may depend on the arrangement of the poles.

One method is to create a grid by positioning strings in rows of straight lines along an x-axis and a y-axis relative to the ground. When using this method, the points where the strings intersect will provide guidance as to where each pole 10 will be inserted. String may also be used to position poles in a straight line, or other arrangement relative to each other. Other methods for determining the site of pole insertion may also be used, including but not limited to, optical or conventional surveying methods, or any other method known in the art.

When using string to identify the insertion location for creating a grid of poles the intersection of the x- and y-axis strings will create a cross with four quadrants. After creating a string grid, each pole will be inserted into a specific quadrant, and therefore each hole is created in a specific quadrant. In one embodiment, the poles will be placed in the same quadrant at each x, y intersection. A hole is drilled, dug or otherwise created at the insertion location in a specific quadrant.

Another embodiment uses standard positioning technology to determine the insertion location for each pole. When using positioning technology, prism 70 may be used to determine the location for each hole. Prism 70 is carried, transported or otherwise moved throughout the work site and specifically indicates the target insertion location.

A plurality of holes are created in a specific arrangement in ground 8. The depth and width of each hole is determined by the operator, taking into account the length, width and desired height of the pole. Typically all holes are dug, drilled or created after locating the site for pole insertion. However, if there is a high water table the holes may be created just ahead of pole insertion to reduce water seepage into the hole. The timing of creating the holes is not important, and may be adjusted as desired, for the reason stated above or for any reason.

In a preferred embodiment, each hole is filled with wet concrete. Typically, the holes are filled approximately 5 to 10 holes ahead of the pole-positioning device to ensure that the wet concrete does not harden too much before the pole is inserted. Again however, the timing of filling each hole with wet concrete is determined by the operator, taking into account the speed of pole insertion, the weather conditions, the quality of concrete or other factors.

After the holes are created the pole-positioning device is brought relatively close to a first hole and used to plumb and position a first pole. The device should be close enough to each hole so that the clamshell support is over each prepared hole.

Each pole will be consistently positioned. When using a string grid, the pole-positioning device will be transported close enough to the hole so that pole 10, when vertical, will not touch the string, and is, for example, about ½ inch from the x-axis string and about ½ inch from the y-axis string. Using this technique ensures that pole 10 does not push on the strings, and will not cause displacement of the strings. Obviously, the poles may be consistently positioned ¼ inch away from a string, ¾ inch away from a string or any other distance that is convenient. The distance, once chosen, should be as consistent as possible to maintain accuracy in placement.

Another embodiment uses positioning technology consistently position the pole-positioning device, and to bring the pole-positioning device close to the target hole. The specific requirements for pole placement are programmed into the positioning system, and used to set up specific location for each pole, as needed for the unique array, series or arrangement of the poles relative to each other and relative to the work site. In one embodiment, a prism 70 is placed on top of clamshell 12, and is used with existing positioning technology. The pole-positioning device is moved close to the target hole and the positioning technology is used to locate the exact site on the ground for pole placement.

In this embodiment, prism 70 is first placed on clamshell 12 when clamshell 12 is in the vertical position. Once prism 70 is set on clamshell 12, prism 70 is used to position the pole-positioning device on the ground along x- and y-axes ground coordinates. Pole 10 is also adjusted to be plumb vertical or at another angle, as desired.

The pole-positioning device is brought close to a first hole, as described above. Prism 70 is removed, and clamshell 12 is put in a horizontal orientation. Clamshell 12 may be raised and lowered by any means known, including hydraulically, with compressed air, manually, or with pulley 62. Clamshell 12 receives pole 10, and compression device 40 or 41 is engaged thereby securing pole 10 in position in clamshell 12. Vibrator 51 is connected with pole 10. Clamshell 12 containing pole 10 is raised and secured to clamshell support 14. For other arrangements of poles different techniques known in the art may be used to identify the pole insertion location.

In one embodiment, pole 10 is loaded into clamshell 12, and clamshell 12 and pole 10 are raised to a substantially vertical position. The clamshell and pole are plumbed to a true vertical position using the clamshell actuator controls, which manipulate the clamshell around ball joint 60 to achieve a plumb position, or alternatively to a specific angle.

In another embodiment, clamshell 12 is raised to a substantially vertical position, without a pole. The clamshell is adjusted using the clamshell controls until clamshell 12 is plumb or the desired vertical angle is achieved.

The pole-positioning device is comprised of moveable platform 24 that rests on top of support platform 26 with a grease layer in between the two platforms to allow the moveable platform to slide over the surface of the support platform. In one embodiment, the moveable platform will contain grease fittings to receive a grease gun, so that additional grease may be applied as needed. A counterweight 66 is attached to the top surface of the moveable platform, and in one embodiment also has as a step 67.

Figure 5:
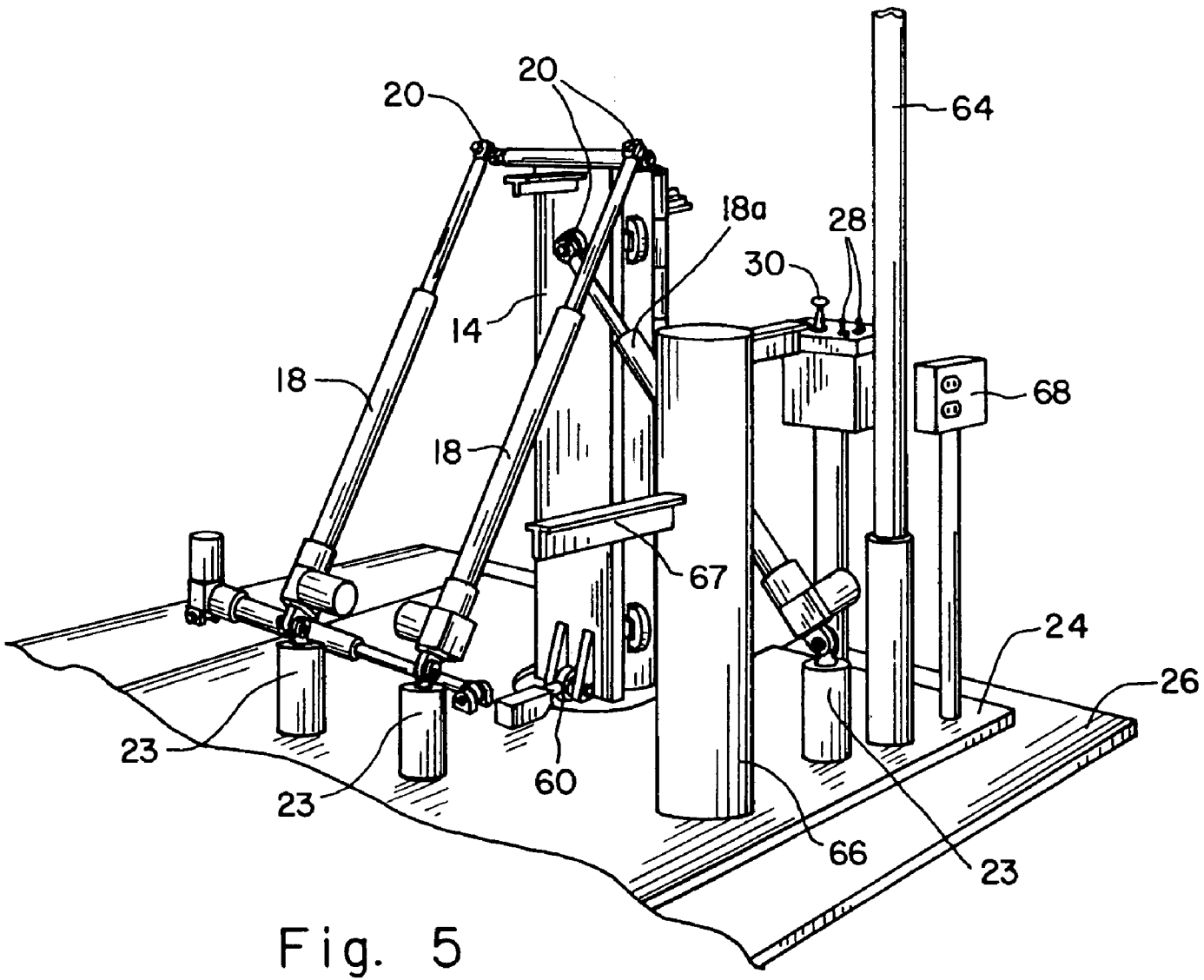
FIG. 5 shows a perspective partial view of one embodiment of the invention.

A clamshell 12 is moveably connected with the moveable platform 24 through clamshell support 14. Clamshell support 14 has two ends, a top end and a bottom end. The bottom end is connected with moveable platform 26 through ball joint 60, as shown in FIG. 5, and is also connected to clamshell 12 through rotational hinge 11. Ball joint 60 acts as a fulcrum, allowing clamshell support 14 to pivot around ball joint 60.

Clamshell support 14 also has two faces. The first face of the top end has locking mechanism 16 that will lock and retain clamshell 12 and connect it with the clamshell support 14 in a substantially vertical position. The second face of the top end is connected with clamshell actuators 18. Rotational hinge 11 is connected with the first face at the bottom end of clamshell support 12.

Clamshell 12 moves independently from the clamshell support 14 and may move from a locked vertical position to a horizontal position by rotating through rotational hinge 11. Clamshell support locking mechanism 16 retains clamshell 12 in a vertical position. Clamshell 12 has a bottom end and a top end. The bottom end is connected with clamshell support 14 through a rotational hinge 11. Rotational hinge 11 allows clamshell 12 to move between a horizontal orientation and a vertical orientation while remaining connected with the clamshell support 14 through rotational hinge 11. Clamshell support 14 connects the clamshell 12 with moveable platform 24.

Figure 8:
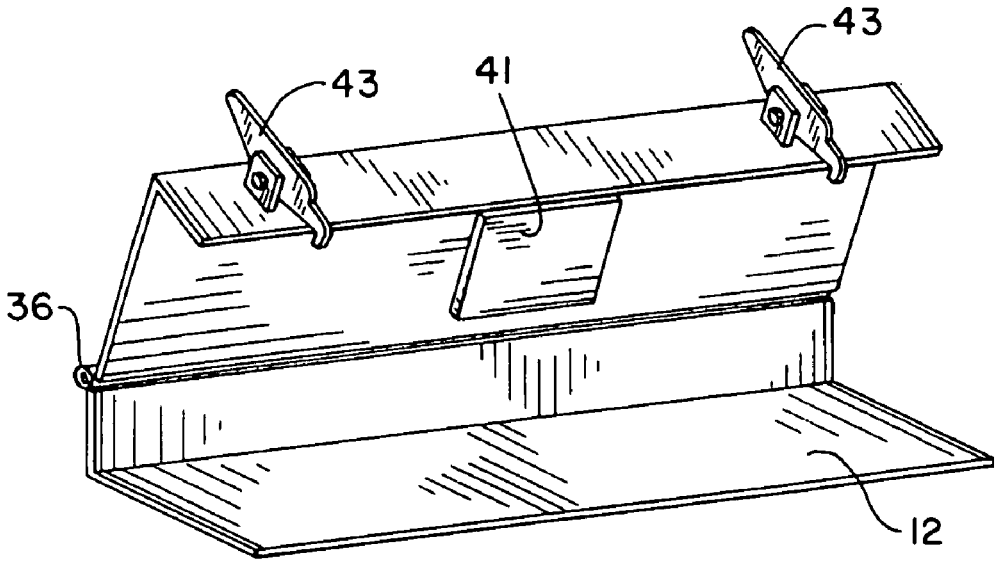
FIG. 8 shows one embodiment of the clamshell.

Clamshell 12 has hinge 36 that runs along its length, allowing the clamshell to open and close. When in the horizontal position, the clamshell may be opened along the hinge to receive a pole 10. Alternatively, pole 10 may be loaded into clamshell 12 without opening clamshell 12. Once the pole is in place in one embodiment, one or more T-handles 42 are turned to close and secure the clamshell. In another embodiment, latches 43 are used to close and secure clamshell 12, as shown in FIG. 8.

Figure 2:
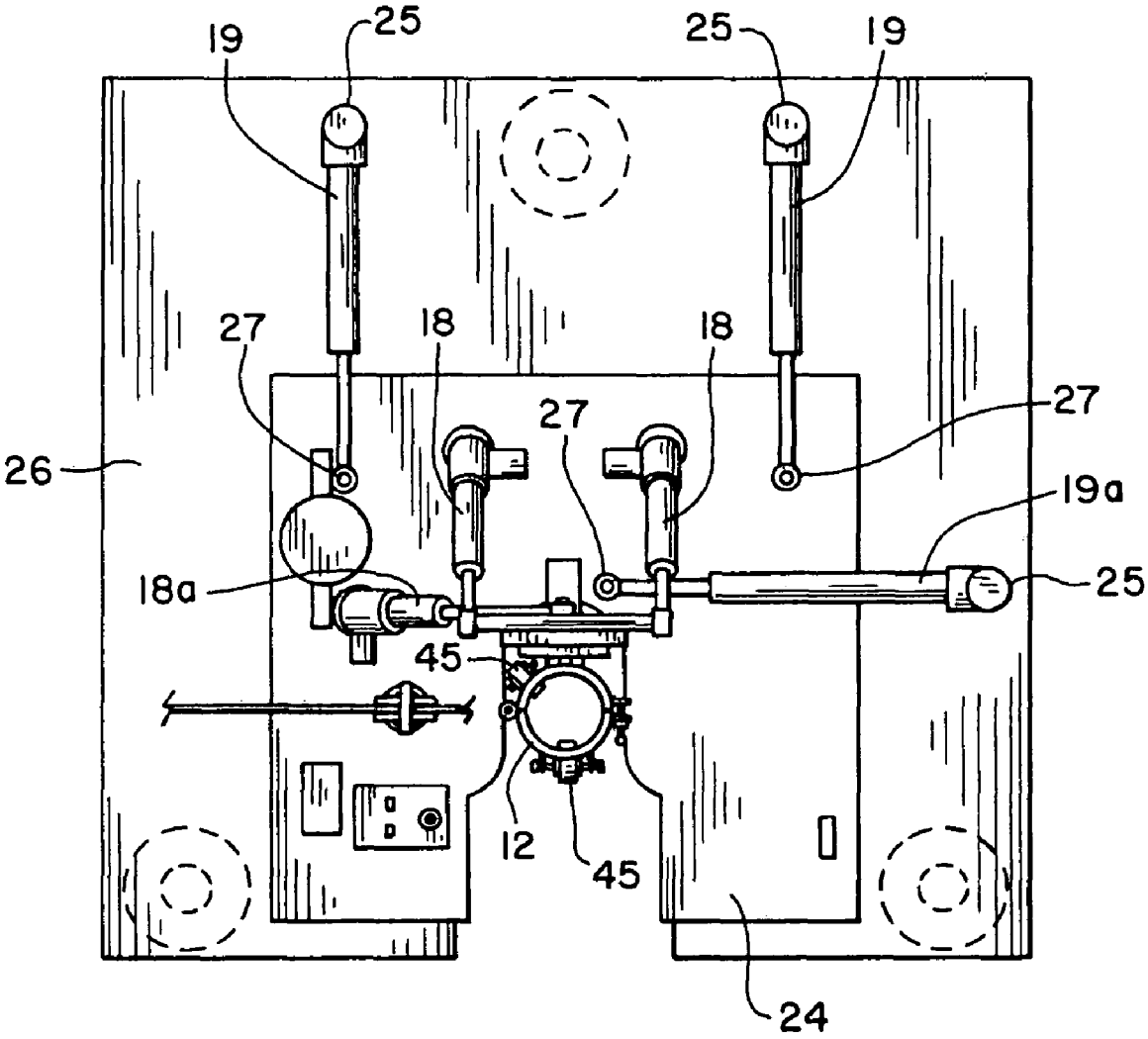
FIG. 2 shows a top plan view of one embodiment of the invention.
Figure 6:
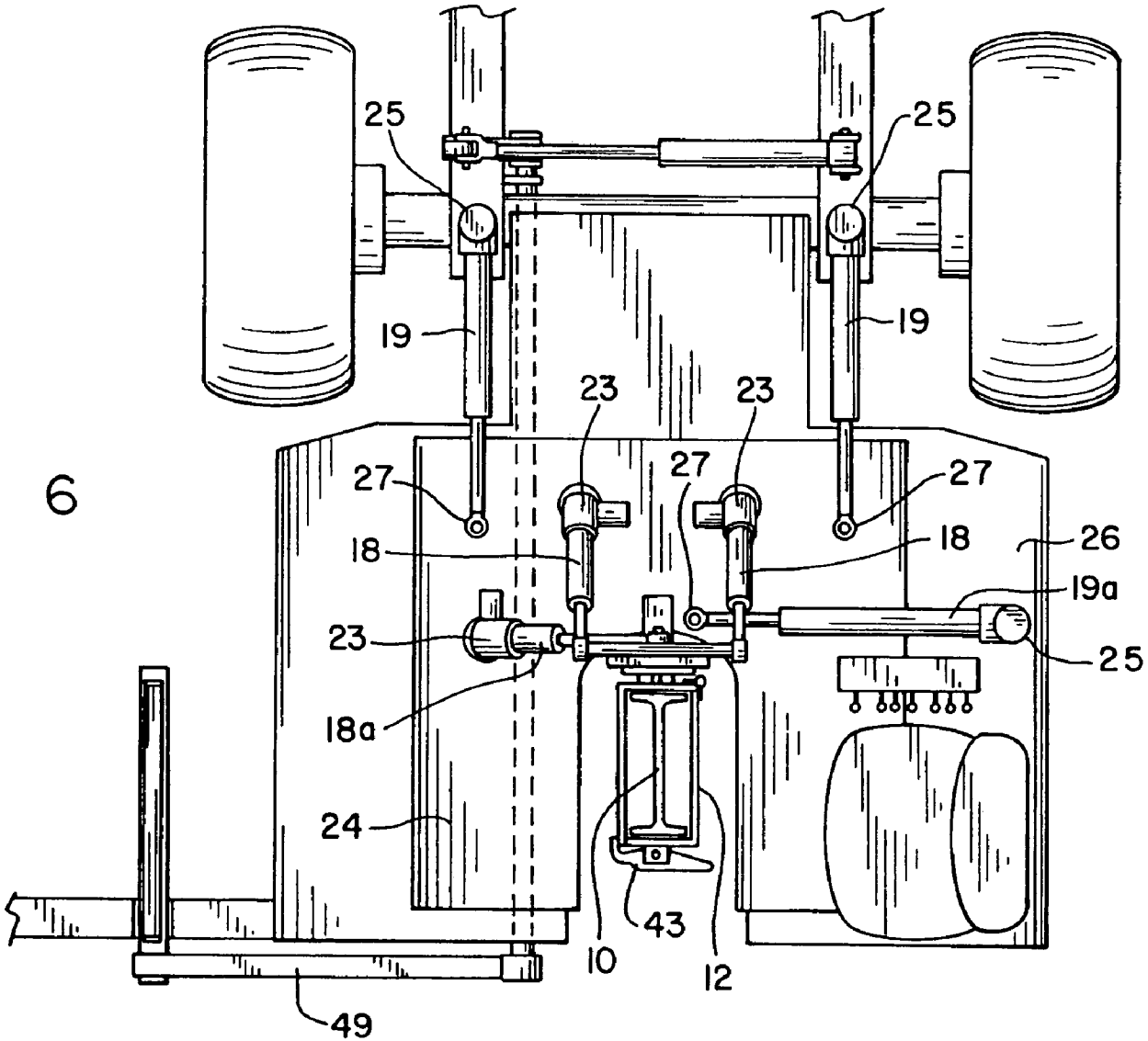
FIG. 6 shows a top plan view of an embodiment of the invention.

Clamshell may be of any shape needed to accommodate the pole. In one embodiment, as shown in FIG. 2, the interior cross-section of the clamshell is circular to receive a pole with a circular cross-section. In other embodiments, the interior cross-section of the clamshell is rectangular to receive an I-beam, as shown in FIGS. 6 and 8. Other interior cross-sections may be used, as needed, to accommodate and receive different types of poles, shafts, posts etc.

Figure 4:
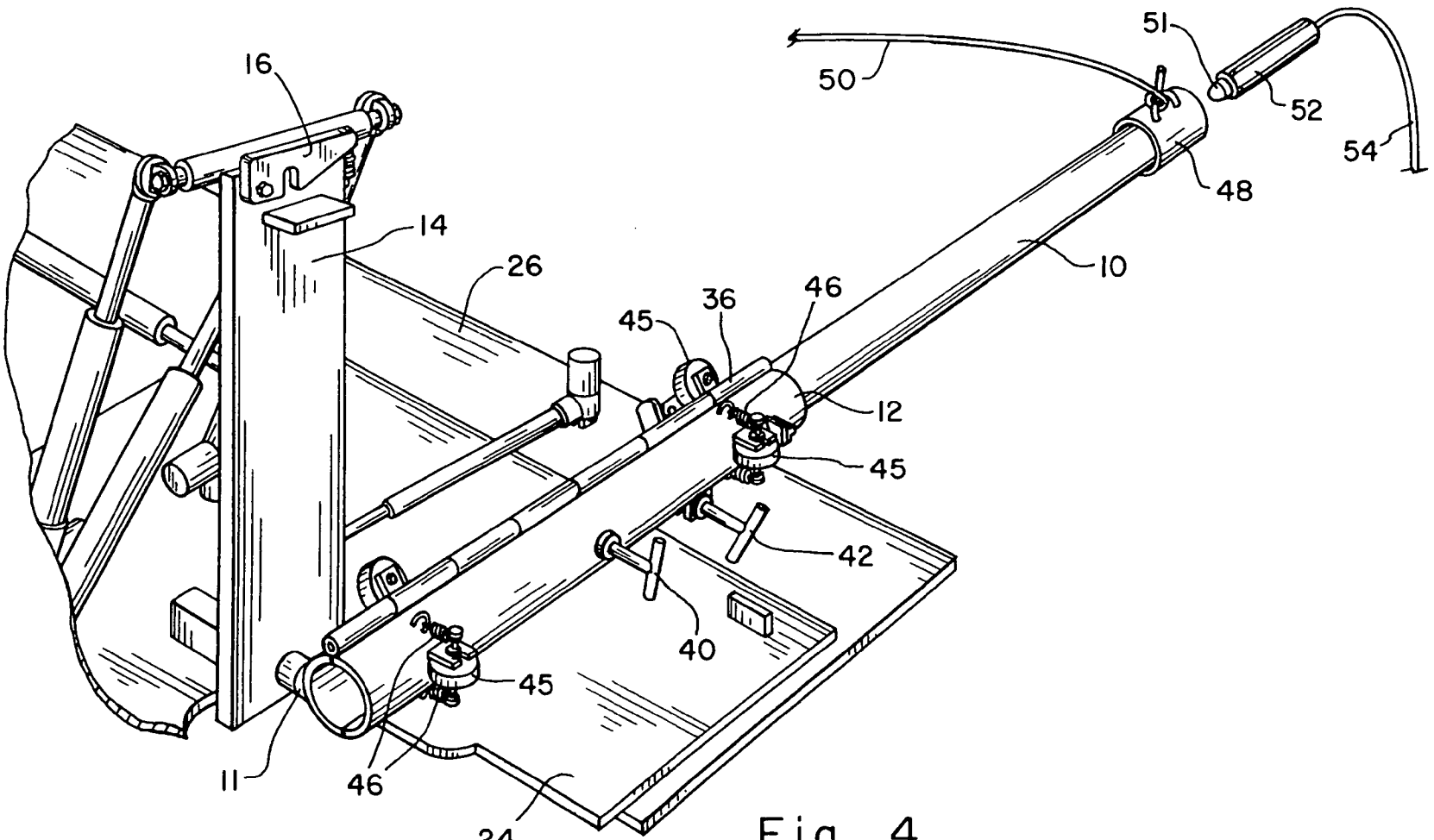
FIG. 4 shows a perspective partial view of one embodiment of the invention.

Clamshell 12 has a compression device that goes through the clamshell 12 to apply pressure on the pole 10, thereby holding the pole in place when the pole and clamshell are vertical. In one embodiment, the compression device is a bolt and handle combination 40 that allows the bolt to be screwed in against the pole, as shown in FIG. 4. In another embodiment, compression device is a square, rectangular or other shaped plate 41 that is capable of pressing against an I-beam or other pole. Plate 41 is pressed against pole 10 using a bolt, compressed air, an air-actuated diaphragm similar to air brakes, or using any other means to press plate 41 against pole 10.

The compression device has the ability to hold the pole in place while clamshell 12 and pole 10 are vertical, to partially release pole 10 allowing it to drop down at a rate slower than gravitational falling, and the ability to fully release the pole. With compression device 40, the bolt and handle, this action is achieved by turning the handle and screwing the bolt further into the clamshell, thereby pressing harder against the pole 10. With compression device 41, the plate, this action is achieved by either screwing the bolt further into the clamshell, activating compressed air, or using any other means to press the plate against pole 10.

Clamshell 12 may have guides to allow pole 10 to slide through the clamshell without tilting or shifting from the starting angle. In one embodiment, the guides are a series of wheels attached to the walls of the clamshell. In another embodiment, the guides are wheels 45 attached to the walls of the clamshell via springs 46, where springs 46 pull the wheels 45 against the pole. When the pole and clamshell are vertical and the compression device is released the wheels allow the pole to slide down, while at the same time retaining the vertical alignment. In yet another embodiment, there are no guides at all, and pole 10 simply slides through clamshell 12.

Figure 3:
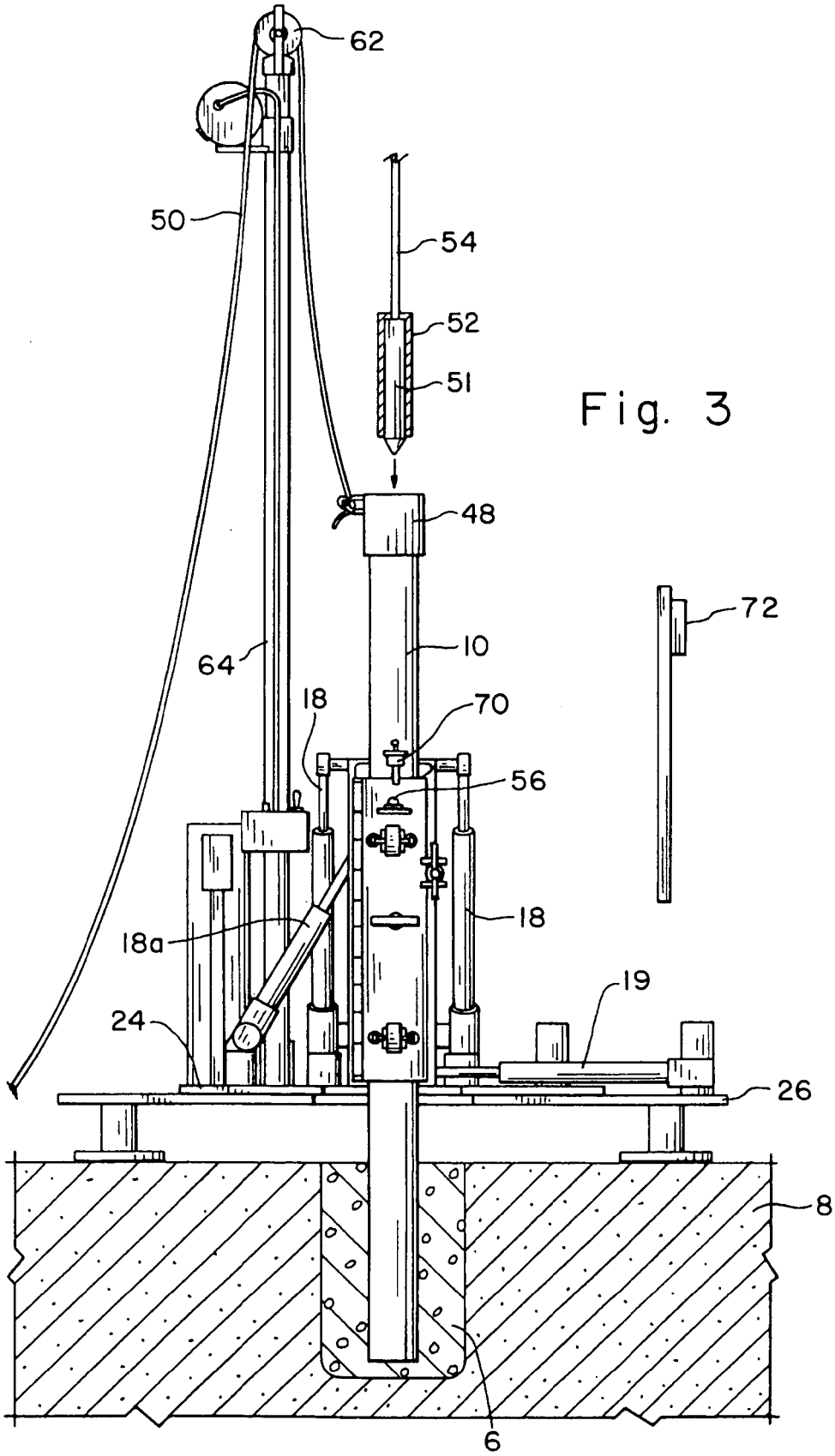
FIG. 3 shows a side view of an embodiment of the invention, with a cut-away view of the ground showing a positioned and placed pole.

In one embodiment, once pole 10 is inserted into clamshell 12 and the clamshell is secured, vibrator 51 may be inserted in the top of a pole if said pole has a hollow core, as shown in FIG. 4. In another embodiment, a vibrator 51 may be connected with the top of pole 10 using clamps, bolts, tape or any other means. Vibrator 51 is used to transmit vibrations to pole 10 helping the pole sink into the wet concrete 6 to the desired depth. In one embodiment, the vibrator is encased in an annulus 52 where the diameter of the outside wall of the annulus corresponds to the diameter of the inside wall of a hollow pole, more effectively transmitting the vibrations from the vibrator to the pole, as shown in FIG. 3. The vibrator is connected via a power cord 54 to the power source 68.

Figure 7:
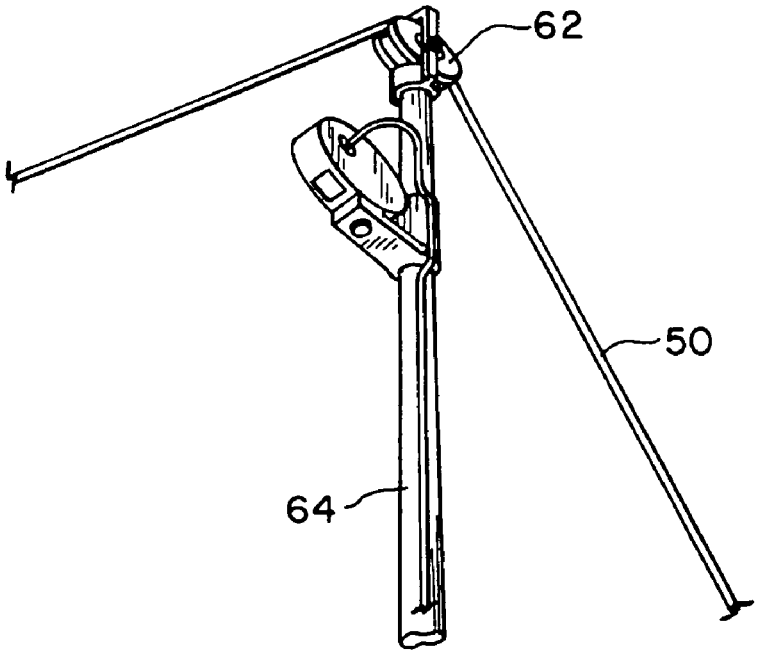
FIG. 7 shows a perspective partial view of one embodiment of the invention.

After the pole 10 is received by and secured in clamshell 12, the clamshell is moved to a substantially vertical position adjacent to the clamshell support 14. In one embodiment this is accomplished by a ring 48 that is placed around the end of pole 10, as shown in FIG. 4. Ring 48 is attached to rope 50, which runs though pulley 62 attached to pulley support 64, as shown in FIG. 7. The operator pulls rope 50, thereby raising the ring 48, pole 10, and clamshell 14 from a horizontal orientation to a vertical orientation. Clamshell 12 is locked into place and connected with clamshell support 14 by locking mechanism 16. The locking device 16 on the clamshell support 14 is used to lock the clamshell 12 in position.

In another embodiment, clamshell 12 is raised from a horizontal orientation to a substantially vertical orientation by a lift 49, as shown in FIG. 6. Lift 49 is a standard lift mechanism that is activated by either the foot or hand, using hydraulics, compressed air, or any other means to raise lift 49. Once activated, lift 49 raises clamshell 12 to a substantially vertical position.

Pole 10 is plumbed and positioned above the hole, as described above. Compression device 40 or 41 is partially released, allowing pole 10 to drop at a rate slower than gravitational falling to a height a few inches above ground 8. Pole 10 is exactly positioned above the insertion location using the string grid, positioning technology, or other means known in the art, by sending commands from the platform actuator controls to platform actuators 19, thereby moving moveable platform 24.

Once pole 10 is exactly positioned over the insertion location compression device 40 or 41 is fully released and pole 10 drops into the wet concrete 6. After pole insertion, the pole-positioning device is moved to a second hole and a second pole is plumbed, positioned, and inserted. This sequence is repeated as many times as necessary to create the desired arrangement of plumb poles. The order of steps may be varied to suit the convenience of the operator.

In one embodiment, power source 68 is connected with support platform 26, although it is obvious that power for the device may be supplied by a power source that is not connected with the support platform. The power source is used to provide power to the controls and to the vibrator, or for any other use, as needed.

There are two sets of controls, the platform actuator controls and the clamshell actuator controls. The actuator controls are connected with each actuator in a manner that allows the transmission of signals from the control to the actuator to cause the associated actuator to expand or contract. Because each actuator is separately connected with a control each actuator is controlled and will move independent of the others, providing sensitive and accurate adjustments. Each actuator control may be a joystick, or a series of toggle switches, or any other control mechanism that allows the control to transmit instructions to the actuators. In one embodiment, a joystick control 30 is attached to all platform actuators, or all clamshell actuators, so that the operator can move the joystick to operate all associated actuators at once. In another embodiment, a toggle switch 28 is used for each actuator, and manipulating each toggle switch will cause a reaction in the associated actuator. In yet another embodiment, a combination of joystick and toggle switches are used. In other embodiments, a trackball may be used, or any other means to provide control between the controls and the actuators.

For convenience, the clamshell actuator controls will be referenced as 30, although the clamshell control does not necessarily have to be a joystick, as described above. The clamshell actuator controls 30 are used to plumb pole 10. The clamshell actuator control system is connected with actuators that connect moveable platform 24 to clamshell support 14. In one embodiment, each clamshell actuator 18 is connected with the second face of clamshell support 14 at or near the top end of clamshell support 14.

Each clamshell actuator 18 has a first end that is attached to the top end of the clamshell support 14 by a ball joint 20 and a second end that is attached to the moveable platform 24 by ball joint 23. Each actuator 18 expands and contracts telescopically in response to commands from the clamshell actuator controls. When the operator manipulates the clamshell actuator controls 30 actuators 18 are activated, and extend and contract causing clamshell support 14, attached clamshell 12, and pole 10 to move in all directions, thereby allowing the operator to plumb the pole, or, if desired, to adjust pole 10 to a specific angle. In one embodiment, the clamshell support has a level 56 or levels that the operator uses to determine if the pole is plumb. In another embodiment, the clamshell itself has a level 56 or levels that are used to adjust or plumb the pole.

It is apparent that the device may be used to plumb poles, or to set each pole at a specific angle. Thus, if the operator wants to have one or more poles set at a specific angle the operator would use a level 56 or other guide to determine the correct angle for each pole.

As stated above, clamshell support 14 has ball joint 60 at its bottom end. Ball joint 60 acts as a fulcrum around which clamshell support 14 and the locked clamshell 12 pivot. The actuators 18 are connected with and apply pressure to the top end of clamshell support 14 causing it to move and pivot around the ball joint fulcrum. Actuators 18 can move the top of clamshell 12 in all directions, while pivoting around ball joint 60. In one embodiment, this is accomplished by having two actuators 18 that connect moveable platform 24 to clamshell support 14 to move clamshell support 14, clamshell 12, and pole 10 in a direction along an x-axis, and one actuator 18*a* that connects the moveable platform 24 to the clamshell support 14 to move the clamshell support 14, clamshell 12, and pole 10 in a direction along a y-axis. The terms "x-axis" and "y-axis" are used here to indicate two directions that are perpendicular to each other and substantially parallel to the ground; the x- and y-axes of these actuators do not have to correspond to the x- and y-axes of the string, although they may.

This embodiment has two actuators 18 in the x-axis to ensure that the moveable platform moves in a straight line. Another embodiment has only one actuator 18 to move the moveable platform along the x-axis, although in this embodiment the actuator must be positioned exactly to push and pull the platform in a straight line. In practice, it is easier and more stable to use two actuators to push and pull in along the x-axis. It is apparent that any number of actuators, including or greater than one, may be used in the x-axis, or the y-axis, or both.

If two (or more) actuators are used to adjust along the x-axis, it is only necessary to have one actuator 18*a* to adjust along the y-axis, as shown in FIGS. 2 and 6. However, any number of actuators may be used, including or greater than one, to adjust along the y-axis.

The operator manipulates the clamshell actuator controls 30 until the pole is plumb, or at the desired angle, as determined by the level or levels 56. Then, compression device 40 or 41 is partially loosened until gravity causes pole 10 to slide down, while the compression device applies friction to prevent the pole from immediately dropping to the ground. Guides 45, if used, allow the pole to slide while applying pressure to keep the pole vertical. The pole is allowed to drop until it is just above ground 8.

The platform actuator controls are manipulated to control actuators 19, thereby moving moveable platform 24 to exactly position clamshell 12 and pole 10 above the insertion location. For convenience, the platform actuator controls will be referenced as 28, although they are not limited to toggles, as described above. The platform actuator controls 28 are used to position clamshell 12 and pole 10 by sending commands from controls 28 to actuators 19, thereby moving moveable platform 24 to which they are attached. Each platform actuator 19 has two ends, a first end that is permanently connected with support platform 26 by joint 25, and a second end that is permanently attached to the moveable platform by joint 27. The platform actuator controls 28 are connected with actuators 19 so that actuators 19 can receive signals from controls 28. When the operator manipulates the platform actuator controls 28 actuators 19 are activated, and extend and contract in a telescopic manner, thereby moving the moveable platform relative to the support platform. Activation of the actuators will move the moveable platform and associated clamshell and pole to the exactly position the pole over the hole.

Support platform 24 may be a solid platform, as shown in FIG. 3. Or it may include part of the pole-positioning structure, as shown in FIG. 6. Support platform 24 thus includes any part of the pole-positioning device that remains stable relative to the movement of movable platform 24.

In one embodiment, there are two actuators 19 that connect the moveable platform 24 to the support platform 26 along an x-axis, and one actuator 19*a* that connects the moveable platform 24 to the support platform 26 along a y-axis. The terms "x-axis" and "y-axis" are used here to indicate two directions that are perpendicular to each other and substantially parallel to the ground; the x- and y-axes of these actuators does not have to correspond to the x- and y-axes of the string, although they may.

There are two actuators 19 in the x-axis to ensure that moveable platform 24 moves in a straight line. If only one actuator is used to move moveable platform 24 along the x-axis then that actuator must be positioned exactly to push and pull the platform in a straight line. In practice, it is easier and more stable to use two actuators 19 to push and pull along the x-axis. It is apparent that any number of actuators, including or greater than one, may be used in the x-axis, or the y-axis, or both.

If two (or more) actuators are used to adjust along the x-axis, it is only necessary to have one actuator 19*a* to adjust along the y-axis. Again, any number of actuators may be used, including or greater than one, to adjust along the y-axis.

As described above, pole 10 is retained in clamshell 12 by compression device 40 or 41, and is suspended vertically above the ground. Moveable platform 24 is moved in response to commands sent from platform actuator controls 28 to bring suspended pole 10 to the insertion location, as determined with reference to strings, laser, or any other method used to determine the location for pole insertion.

Once pole 10 is plumbed and in position, compression device 40 or 41 is fully released and pole 10 drops into the wet concrete through gravity. Vibrator 51, if used, is turned on and will cause vibrations in pole 10 assisting the pole to drop through the wet concrete. The dropping action continues until pole 10 is inserted to the desired depth. This may be determined though a mark on the outside of the pole. Once the pole is at the target depth or height vibrator 51, if used, is turned off and removed from pole 10. Clamshell 12 is opened along hinge 36 and the pole-positioning device is moved away from the hole. The pole-positioning device is moved to the next hole, and the process is repeated as many times as desired.

In another embodiment, in order to set the exact height of pole 10, laser receiver 72 is used. Receiver 72 is programmed to receive a signal from a laser that emits in a plane at a pre-determined height above the ground. The plane height may be varied, as desired, and such variances are programmed into the laser transmitter.

In one embodiment, receiver 72 is removeably connected with a rod, measure, or other long, straight object. The rod with receiver 72 is placed near pole 10 and is used to identify when pole 10 is close to the correct height. In another embodiment, receiver 72 is removeably connected pole 10, and is again used to identify when pole 10 is close to the correct height because the receiver will so indicate. As is currently know in the art, receiver 72 will emit one type of signal when close to the target height, and another type of signal when at the target height.

When pole 10 is at the target height, receiver 72 will intersect the laser-generated plane and will receive the signal from the laser transmitter. Receiver 72 will indicate that it is receiving the laser signal, and that pole 10 is at the correct, target height. In one embodiment, pole 10 is lowered using vibrator 51 until it is close to the correct height. Pole 10 is released from clamshell 12 and receiver 72 placed on top of pole 10. Pole 10 is hit with a hammer or other impact device until laser 72 indicates that the pre-programmed target height is achieved. The laser technology allows for placement of a series of poles at specific locations, with each pole set at a specific height, or for each pole to be at the same height.

Various changes and modification to the invention will be apparent to those skilled in the art. Such changes and modifications may be made without departing from the spirit and scope of the present invention. The embodiments disclosed herein are to be considered in all respects as illustrative and not restrictive, and the scope of the invention is as stated in the claims rather than by the foregoing description. All changes that come within the meaning and range of equivalency of the claims are intended to be embraced therein.

What is claimed is:

1. A pole-positioning device comprising:

a support platform supporting a moveable platform wherein said moveable platform moves relative to said support platform, a plurality of platform actuators connecting said moveable platform with said support platform, wherein each platform actuator has a first end connected with said moveable platform through a joint and wherein each platform actuator has a second end connected with said support platform through a joint, wherein activation of at least one platform actuator moves said moveable platform in a first direction and wherein activation of at least one other platform actuator moves said moveable platform in a second direction that is perpendicular to said first direction, a clamshell support with a top end and a bottom end wherein said top end is connected with a locking mechanism and wherein said bottom end is connected with said moveable platform through a ball joint, a plurality of clamshell actuators wherein each clamshell actuator has a first end and a second end and wherein said first end is connected with said top end of said clamshell support through a ball joint, and wherein said second end is connected with said moveable platform through a ball joint, wherein activation of at least one clamshell actuator moves said top end of said clamshell in a third direction and wherein activation of at least one other clamshell actuator moves said clamshell is a fourth direction that is perpendicular to said third direction, a clamshell with a compression device, a bottom end, a top end, and a hinge running from said top end of said clamshell to said bottom end of said clamshell, wherein said hinge allows said clamshell to open and close, wherein said bottom end of said clamshell connects with said clamshell support through a rotational hinge that allows said clamshell to move from a horizontal orientation to a vertical orientation, and wherein said top end is capable of locking to said clamshell locking mechanism, wherein said clamshell is capable of receiving a pole with a top end and a bottom end, wherein said pole bottom end is inserted in said clamshell, wherein a ring removeably surrounds said top end of said pole, wherein said ring is connected with a rope that runs through a pulley, wherein pulling said rope through said pulley will raise said ring, said pole and said clamshell from a horizontal orientation to a vertical orientation.

2. The pole-positioning device of claim 1, wherein said pole is selected from the group consisting of I-beams, poles, posts, light poles, hollow poles and fence posts.

3. The pole-positioning device of claim 1, wherein, said bottom end of said pole is inserted in said clamshell and said clamshell is raised from a horizontal orientation to a vertical orientation using a lift arm.

4. The pole-positioning device of claim 1, wherein said clamshell is capable of receiving poles with a circular shape.

5. The pole-positioning device of claim 1, wherein said clamshell is capable of receiving poles with a rectangular shape.

6. The pole-positioning device of claim 1, wherein said compression device is a bolt.

7. The pole-positioning device of claim 1, wherein said compression device is a plate.

8. The pole-positioning device of claim 1, wherein said vertical orientation of said clamshell is plumb.

9. The pole-positioning device of claim 1, wherein said vertical orientation is determined by at least one level.

10. The pole-positioning device of claim 1, wherein there are at least two platform actuators capable of moving said moveable platform in said first direction and one platform actuator capable of moving said moveable platform in said second direction, and wherein there are at least two clamshell actuators capable of moving said clamshell in said third direction and one clamshell actuator capable of moving said clamshell in said fourth direction.

11. The pole-positioning device of claim 1, wherein said clamshell also comprises guides for maintaining the vertical orientation of said pole.

12. The pole-positioning device of claim 1, wherein said pole is located at a specific site using a prism and positioning technology.

13. The pole-positioning device of claim 1, wherein, said pole top end is set at a specific height using laser technology.

14. A mobile pole-positioning device comprising:

a support platform supporting a moveable platform wherein said moveable platform moves relative to said support platform, a plurality of platform actuators connecting said moveable platform with said support platform, wherein each platform actuator has a first end connected with said moveable platform and wherein each platform actuator has a second end connected with said support platform, wherein activation of at least one platform actuator moves said moveable platform in a first direction along an x-axis, and wherein activation of at least one other platform actuator moves said moveable platform in a second direction along a y-axis that is perpendicular to said first direction, a clamshell support with a top end and a bottom end wherein said top end is connected with a locking mechanism and wherein said bottom end is connected with said moveable platform, a plurality of clamshell actuators wherein each clamshell actuator has a first end and a second end and wherein said first end is connected with said top end of said clamshell support, and wherein said second end is connected with said moveable platform, wherein activation of at least one clamshell actuator moves said top end of said clamshell in said first direction along said x-axis and wherein activation of at least one other clamshell actuator moves said clamshell is said second direction along said y-axis that is perpendicular to said first direction, a clamshell with a compression device, a bottom end, a top end, and a hinge running from said top end of said clamshell to said bottom end of said clamshell, wherein said hinge allows said clamshell to open and close, wherein said bottom end of said clamshell connects with said clamshell support through a rotational hinge that allows said clamshell to move from a horizontal orientation to a vertical orientation, and wherein said top end is capable of locking to said clamshell locking mechanism, wherein said clamshell is capable of receiving a pole with a top end and a bottom end, wherein manipulation of said platform actuators moves said moveable platform and connected clamshell support bottom end to position said pole exactly in said x- and y- axes, and wherein manipulation of said clamshell actuators moves said clamshell support top end to position said pole exactly plumb.

15. The pole-positioning device of claim 14, wherein said pole-positioning device is used to exactly position and plumb a plurality of poles, comprising:

(a) determining an insertion location for a plurality of poles wherein each insertion location is in specific arrangement relative to other insertion locations, (b) creating a hole at each insertion location, (c) moving said pole-positioning device to position said clamshell over an insertion location, (d) inserting said pole in said clamshell while said clamshell is in a horizontal orientation, (e) securing said pole with a compression device, (f) raising said clamshell and pole from a horizontal orientation to a vertical orientation, (g) manipulating clamshell actuator controls to activate said clamshell actuators thereby plumbing said clamshell, (h) partially releasing said compression device, allowing said pole to drop until just above ground level, (i) manipulating platform actuator controls to activate said platform actuators thereby exactly positioning said pole over said insertion location, (j) fully releasing said compression device allowing said pole to drop into wet concrete, (k) moving said pole-positioning device to another hole and repeating steps (c) through (k) until all poles are inserted in said specific arrangement.

16. The device and method of claim 15 wherein each pole is inserted to a specific height as determined by a laser receiver.

17. The pole-positioning device of claim 14, wherein said pole-positioning device is used to exactly position and plumb a plurality of poles, comprising:

(a) determining an insertion location for a plurality of poles wherein each insertion location is in specific arrangement relative to other insertion locations, (b) creating a hole at each insertion location, (c) moving said pole-positioning device to position said clamshell over an insertion location, (d) inserting said pole in said clamshell while said clamshell is in a horizontal orientation, (e) securing said pole with a compression device, (f) raising said clamshell and pole from a horizontal orientation to a vertical orientation, (g) manipulating clamshell actuator controls to activate said clamshell actuators thereby plumbing said clamshell, (h) partially releasing said compression device, allowing said pole to drop until just above ground level, (i) manipulating platform actuator controls to activate said platform actuators thereby exactly positioning said pole over said insertion location, (j) fully releasing said compression device allowing said pole to drop into wet concrete, (k) moving said pole-positioning device to another hole and repeating steps (c) through (k) until all poles are inserted in said specific arrangement.

* * * * *